US007435095B1

(12) United States Patent
Yi

(10) Patent No.: US 7,435,095 B1
(45) Date of Patent: Oct. 14, 2008

(54) ELECTRICAL INTERCONNECTION SYSTEM

(75) Inventor: Chong Yi, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/811,828

(22) Filed: Jun. 11, 2007

(51) Int. Cl.
*H01R 12/00* (2006.01)

(52) U.S. Cl. ..... 439/61; 439/65; 439/637

(58) Field of Classification Search ..... 439/61, 439/65, 637; 361/788, 796
See application file for complete search history.

(56) References Cited

U.S. PATENT DOCUMENTS 3,328,646 A * 6/1967 Caillat ..... 361/796
4,603,928 A * 8/1986 Evans ..... 439/61
5,190,462 A * 3/1993 Lauchner et al. ..... 439/65
5,283,851 A * 2/1994 Vergnolle ..... 385/134
5,352,123 A * 10/1994 Sample et al. ..... 439/61
5,402,078 A * 3/1995 Hamilton ..... 324/760
5,863,211 A * 1/1999 Sobotta et al. ..... 439/74
6,361,366 B1 3/2002 Shuey et al.
6,392,142 B1 * 5/2002 Uzuka et al. ..... 439/65
6,422,876 B1 * 7/2002 Fitzgerald et al. ..... 439/61
6,540,522 B2 4/2003 Sipe
6,866,518 B1 * 3/2005 Korsunsky et al. ..... 439/61
6,923,655 B2 * 8/2005 Korsunsky et al. ..... 439/65
7,354,274 B2 * 4/2008 Minich ..... 439/65

* cited by examiner

*Primary Examiner*—Briggitte R Hammond
(74) *Attorney, Agent, or Firm*—Wei Te Chung

(57) ABSTRACT

An electrical interconnection system includes a plurality of first boards (11) and a plurality of second boards (13) intersecting with each other for forming an array configuration. Electrical connectors (15) are set at quadrants defined by each horizontal board and each vertical board for an electrical connection therebetween. Electrical connectors on every two adjacent first boards cooperate each other to control a distance between the two adjacent first boards. This arrangement will have no mid-plane set between the horizontal boards and the vertical boards, which will improve system performance while reducing signal interference and signal attenuation.

14 Claims, 8 Drawing Sheets

ELECTRICAL INTERCONNECTION SYSTEM

CROSS-REFERENCE TO RELATED APPLICATIONS

This patent application is related to a pending U.S. patent application Ser. No. 11/504,337, filed on Aug. 15, 2006, and entitled "ELECTRICAL INTERCONNECTION BETWEEN MULTIPLE PRINTED CIRCUIT BOARDS", which is assigned to the same assignee with this application and is incorporated herein by reference in its entirety.

BACKGROUND OF THE INVENTION

1. Field of the Invention

The present invention generally relates to an electrical interconnection, and more particularly to an electrical interconnection system in which a first plurality of printed circuit boards are orthogonally interconnected with a second plurality of printed circuit boards.

2. The General Background

Various electronic systems, such as computers, comprise a wide array of components mounted on printed circuit boards, such as daughterboards and motherboards that are interconnected to transfer signals and power throughout the systems. The transfer of signals and power between the circuit boards requires electrical connectors between the circuit boards that are typically through a backplane. The backplane supports part of an electrical connector that joins the two circuit boards.

Typically, a backplane is a printed circuit board that mounts into a server and communication switches. Multiple daughter cards are plugged into the backplane. One circuit board connects to another circuit board via connectors held in the backplane. Hence, in the past, in order for one circuit board to connect to another circuit board, a backplane was required as a conduit therebetween. As more circuit boards are required, more connections are required with the backplane. Generally, the circuit boards are aligned in parallel, such as a common plane or in parallel planes. The common parallel or planar alignment of multiple circuit boards is, in part, due to the need to afford a space-efficient and good signal quality connection with the backplane.

However, connecting circuit boards via a backplane leads to the potential for signal interference. Because the circuit boards are all connected via the backplane, signals from the various circuit boards may interfere with each other, especially as the signals travel through the common backplane. Additionally, signal strength may be attenuated as signals travel through the backplane. In general, signals passing between two daughterboards pass through at least one connector when input to the backplane and one connector when output from the backplane. The signal is attenuated at each connector.

Thus a need has existed for an electrical interconnection system that directly connects circuit boards. Specifically, a need has existed for an electrical interconnection system that connects circuit boards without a backplane, thereby improving system performance while reducing signal interference and signal attenuation.

BRIEF SUMMARY OF THE INVENTION

An electrical interconnection system in accordance with an embodiment of the present invention includes a plurality of first boards, a plurality of second boards, a housing for receiving the first boards, and a plurality of groups of electrical connectors. The first boards are adjacently stacked one by one. Each of the horizontal boards includes a plurality of slots along a transverse edge thereof. The corresponding slots of the adjacently-stacked first boards are disposed in an aligned relationship. Each of the second boards includes a plurality of actuating members disposed along a mating edge thereof. Each second board is inserted into the aligned slots of the first boards for intersecting the first boards and forming an arrayed configuration therebetween. Each group of electrical connectors includes at least two electrical connectors disposed on opposite surfaces of each first board adjacent the slots. The groups of electrical connectors on every two adjacent first boards cooperate with each other to control a distance between the two adjacent first boards. Thus, this arrangement of the array of horizontal boards and vertical boards with electrical connectors set for an electrical interconnection therebetween will have no mid-plane set between the horizontal boards and the vertical boards, which will improve system performance while reducing signal interference and signal attenuation.

Other objects, advantages and novel features of the invention will become more apparent from the following detailed description of the present embodiment when taken in conjunction with the accompanying drawings.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE PREFERRED EMBODIMENT

Figure 1:
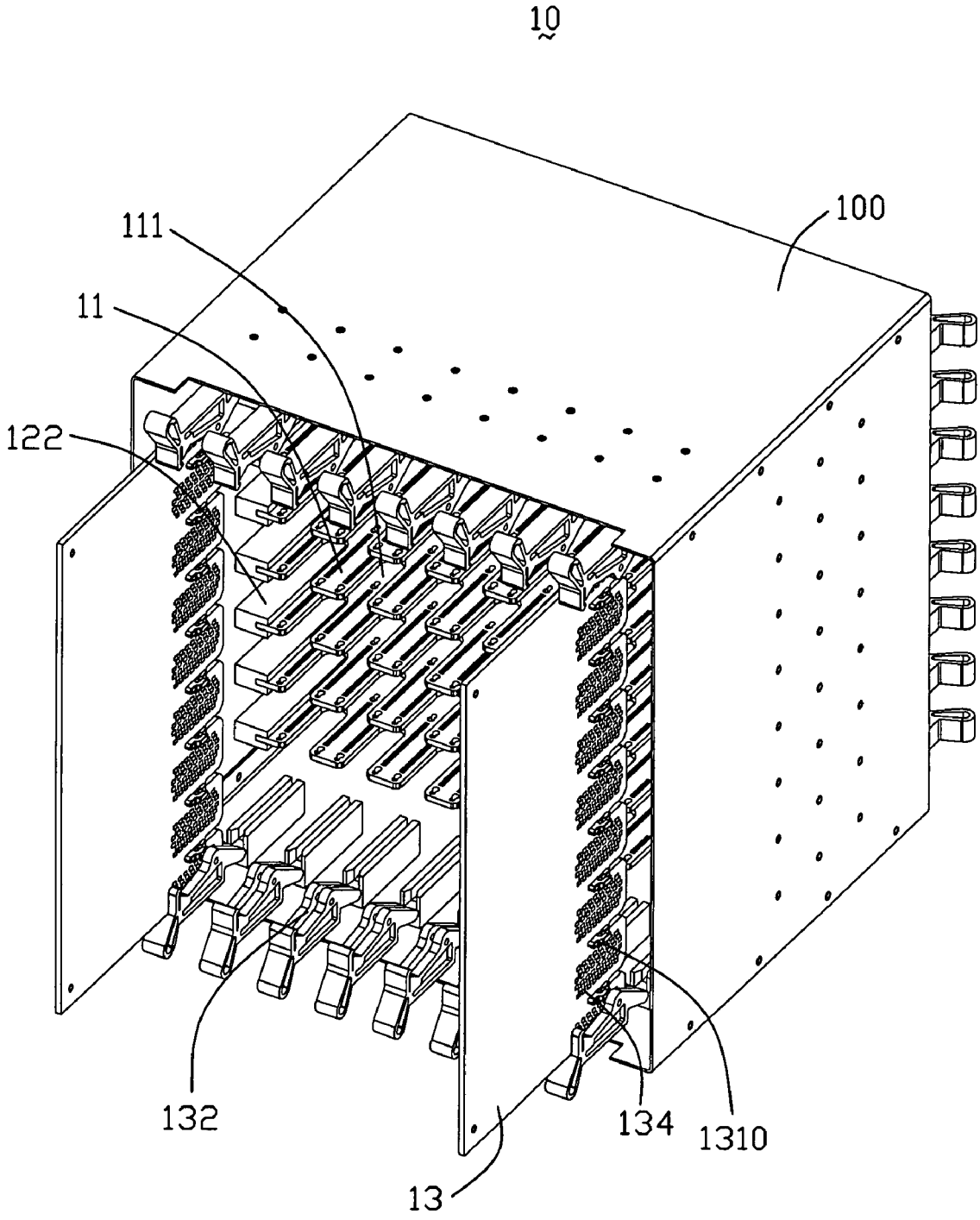
FIG. 1 is a perspective view of an electrical interconnection system in accordance with an embodiment of the present invention, with merely two vertical boards shown and no electrical connectors attached thereto.

Reference will now be made to the drawing figures to describe an embodiment of the present invention in detail.

Figure 2:
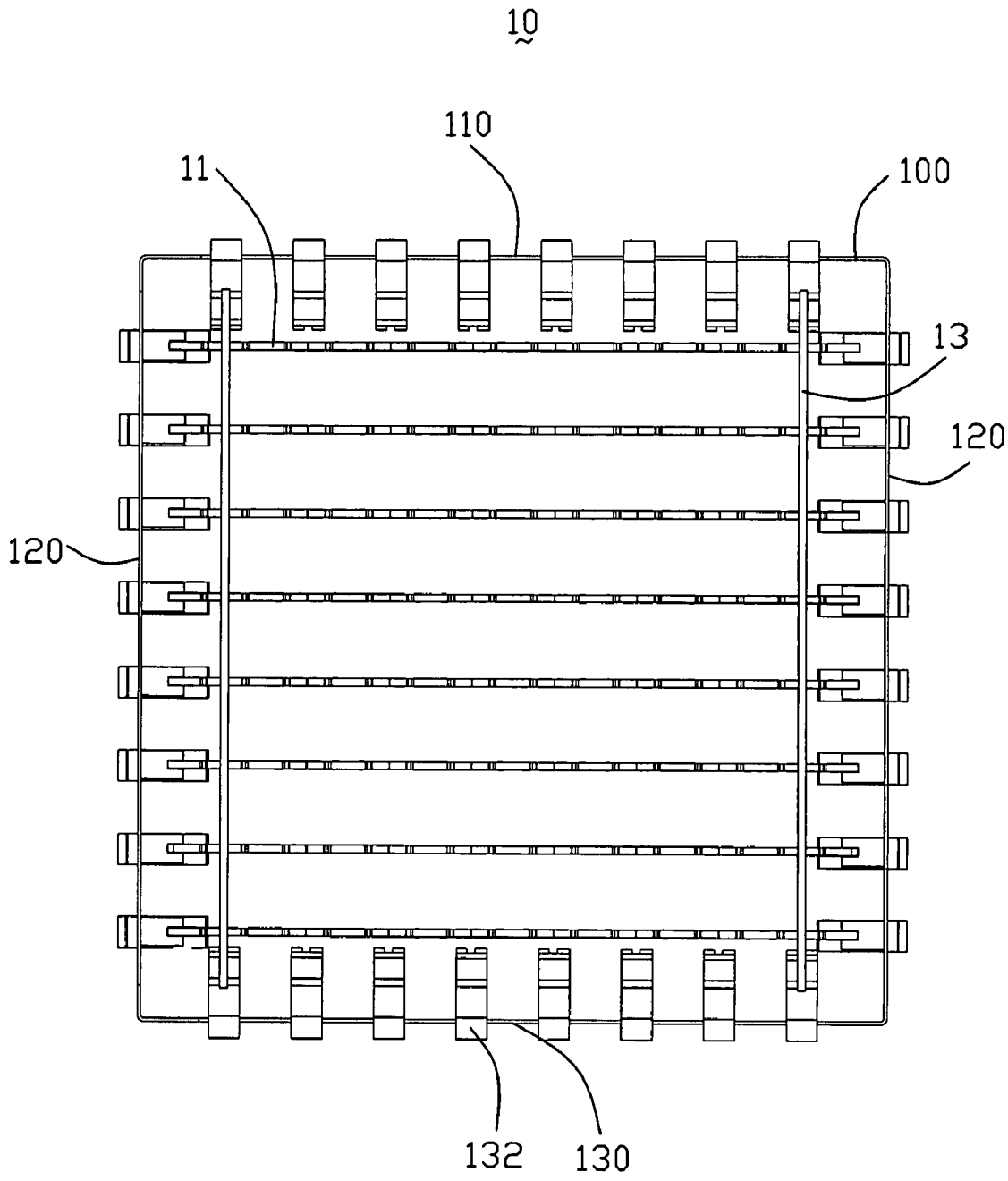
FIG. 2 is a front view of the electrical interconnection system of FIG. 1.
Figure 3:
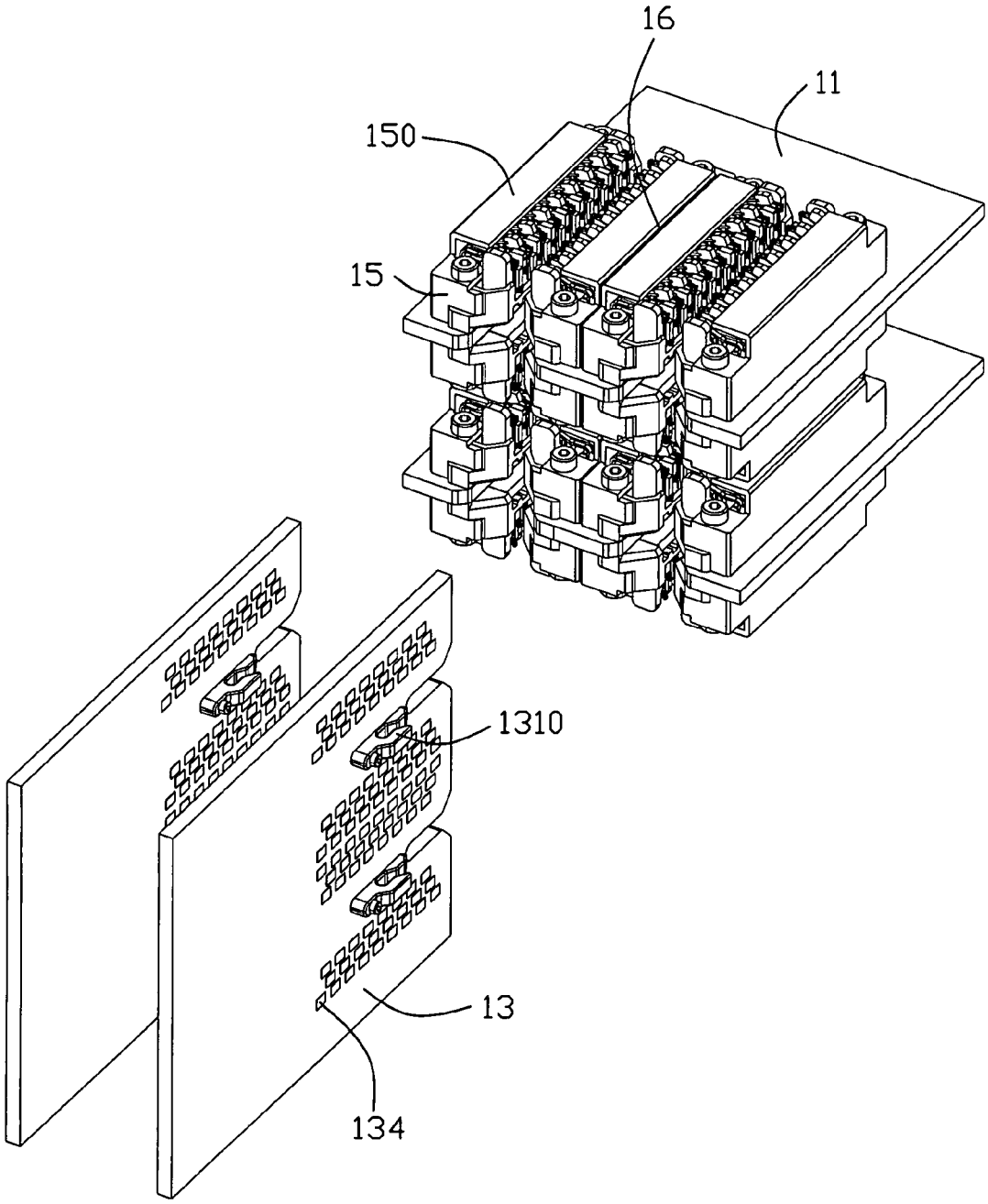
FIG. 3 is a perspective view showing a part of an array of unassembled horizontal boards and vertical boards in the electrical interconnection system of FIG. 1 before the respective vertical boards are inserted into the horizontal boards, with electrical connectors attached thereto.

Referring to FIGS. 1-3, an electrical interconnection system 10 is shown to include an array of stationary, horizontal boards 11 and removable, vertical boards 13 for intersecting with each other, a connector housing 100 for receipt of the array of boards and for holding the array of boards in position, and a plurality of electrical connectors 15 disposed between the horizontal boards 11 and the vertical boards 13 for an electrical interconnection therebetween.

One exemplary connector housing 100 according to this embodiment of the present invention is shown in detail shown in FIG. 1. The connector housing 100 is designed to be square or rectangular shape depending on the overall size of the array of horizontal boards 11 and vertical boards 13, and includes a top wall 110, a bottom wall 130 and opposed side walls 120 extending therebetween. The opposed top and bottom walls 110 and 130 are provided with first means 132 for guiding insertion of the vertical boards 13 into the horizontal boards 11. In this embodiment, the first guide means 132 is in form of transversely-extending, parallel channels formed along inner surfaces of the top and bottom walls 110 and 130. However, the first guide means 132 may have any suitable configuration other than channels of this embodiment, as long as it functions as a guide member. The opposed side walls 120 is also provided with a second holding means 122, in shape identical or different from that of the guide means, for securely holding the horizontal boards 11 in position.

Figure 4:
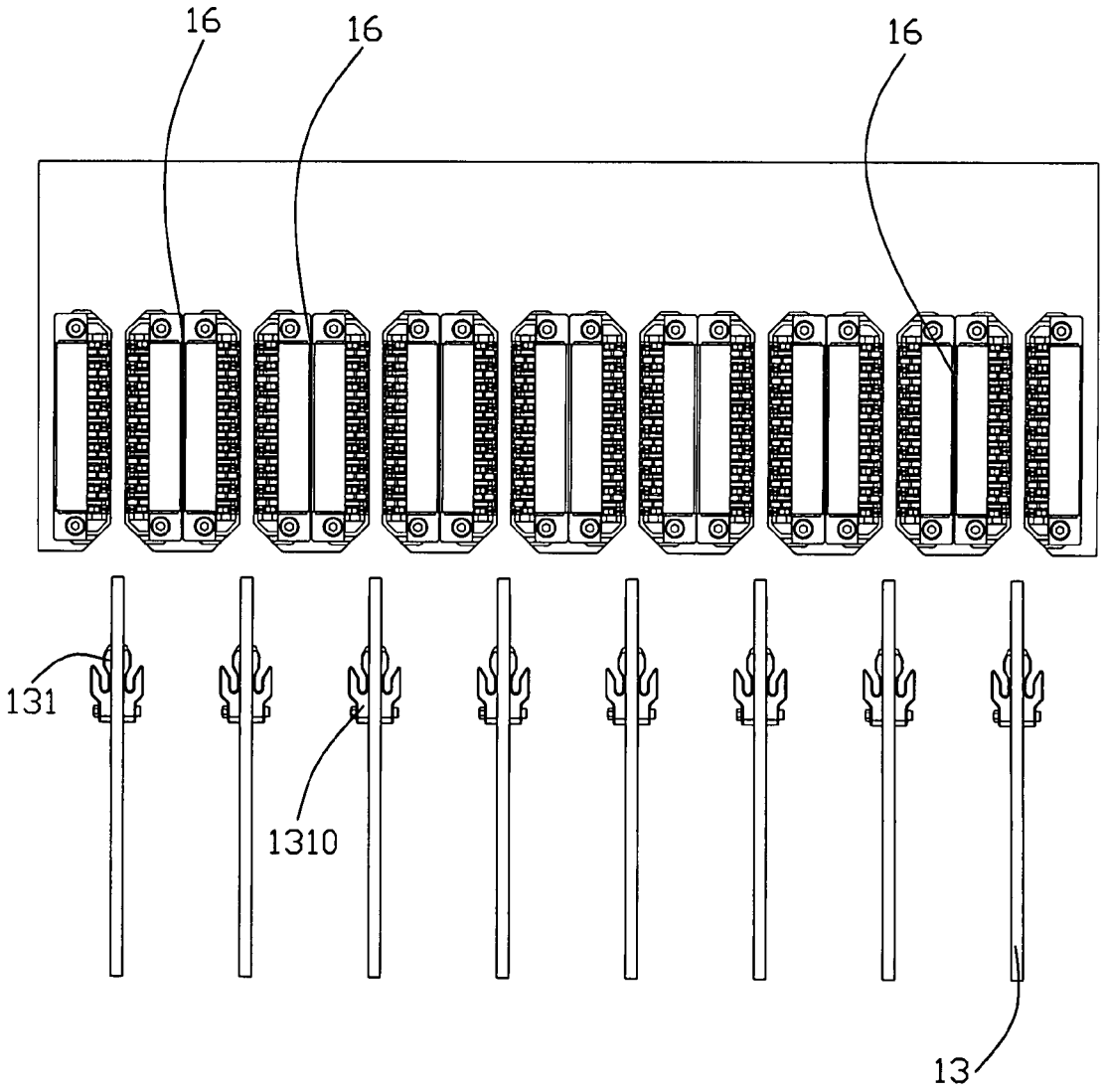
FIG. 4 is a top view of the array of unassembled horizontal boards and vertical boards of FIG. 3.

In this embodiment, the horizontal boards 11, adjacently stacked one by one, are pre-held in position with respect to the connector housing 100 between the opposed side walls 120. Each of the horizontal boards 11 includes a plurality of parallel slots 111 extending along a transverse edge thereof (in FIG. 1) and through opposite surfaces of each horizontal board 11 such that the corresponding slots 111 of the adjacently-stacked horizontal boards 11 are longitudinally aligned with each other so as to be located in a common line, and adapted for one vertical board 13 to be removably inserted into the corresponding slots 111 of the adjacently-stacked of horizontal boards 11, thereby allowing that vertical board 13 to mate with each of the horizontal boards 11. The remaining vertical boards 13 are, in sequence, adapted to mate with each of the horizontal boards 11 in such a manner described above. In addition, each horizontal board 11 includes apertures (not labeled, see FIG. 4) adjacent each slot 111 for allowing the electrical connectors 15 to be bolted down to the apertures on the horizontal boards 11, thereby having the electrical connectors 15 fixed to each horizontal board 11. Horizontal gaps 16 of even or uneven distances may occur due to location tolerances on the horizontal board apertures and the size of the electrical connectors 15.

Figure 7:
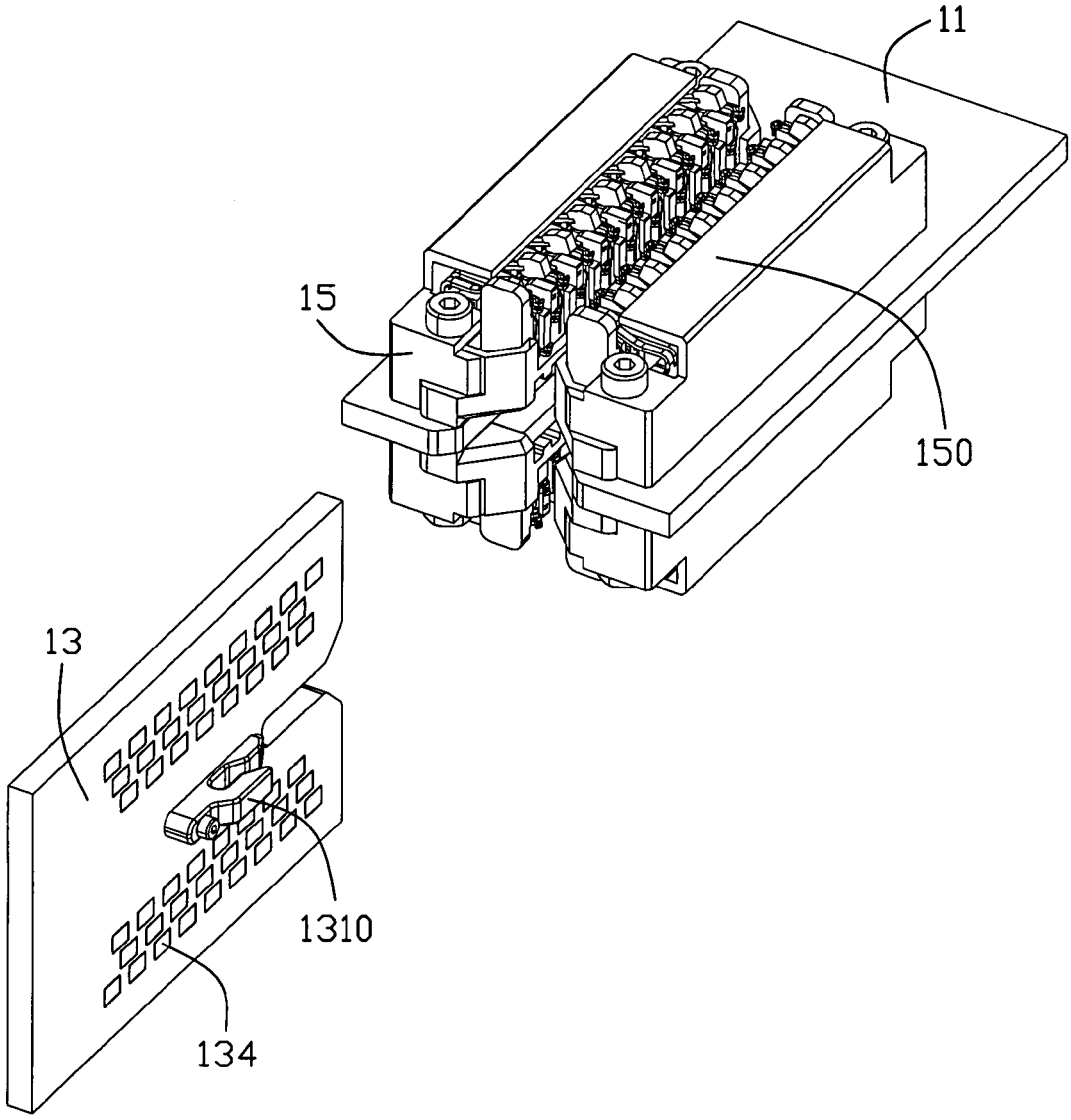
FIG. 7 is a perspective view showing a unit of the array of horizontal boards and vertical boards of FIG. 6, with a group of electrical connectors attached thereto.
Figure 8:
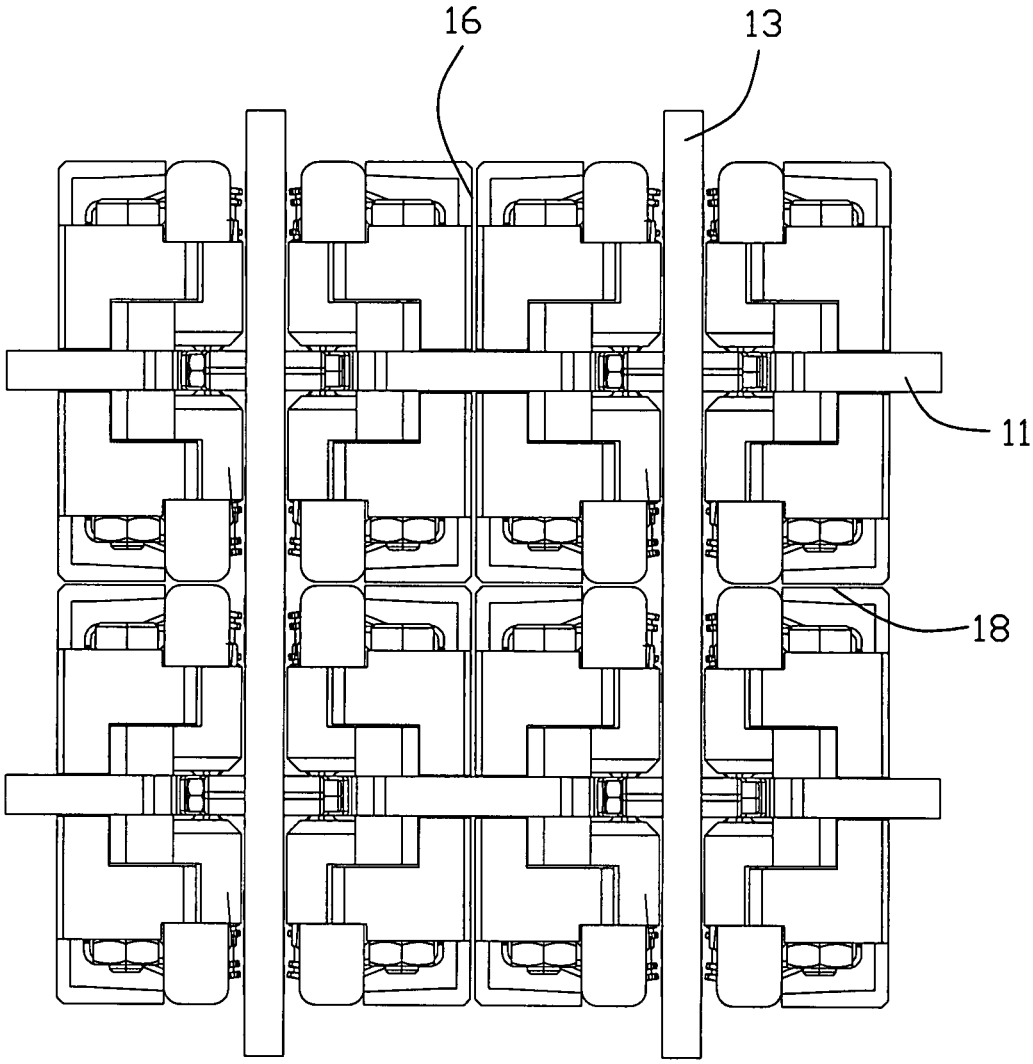
FIG. 8 is a front view showing four units of FIG. 7.

The electrical connectors 15 are divided into a plurality of groups of electrical connectors, with each group including at least two electrical connectors 15 disposed on either the opposite sides of each corresponding slot 111 or the opposite surfaces of each horizontal board 11 for electrically interconnecting each horizontal board 11 and each vertical board 13. Four quadrants are defined by each horizontal board 11 and each vertical board 13. FIG. 7 shows one unit including one group of electrical connectors 15 within the electrical interconnection system 10, while FIG. 8 shows four units having four groups of electrical connectors 15. In this embodiment, each group of electrical connectors includes four electrical connectors 15 located at the respective quadrants, i.e., on both sides of the slot 111 and also on each of opposed surfaces of the horizontal board 11. However, in an alternative embodiment, the group of electrical connectors may include electrical connectors 15 respectively located on at least one of the opposite surfaces of each horizontal board 11 adjacent the slots 111 or at selected quadrants of the horizontal board 11 and the vertical board 13, depending on various design requirements.

Figure 5:
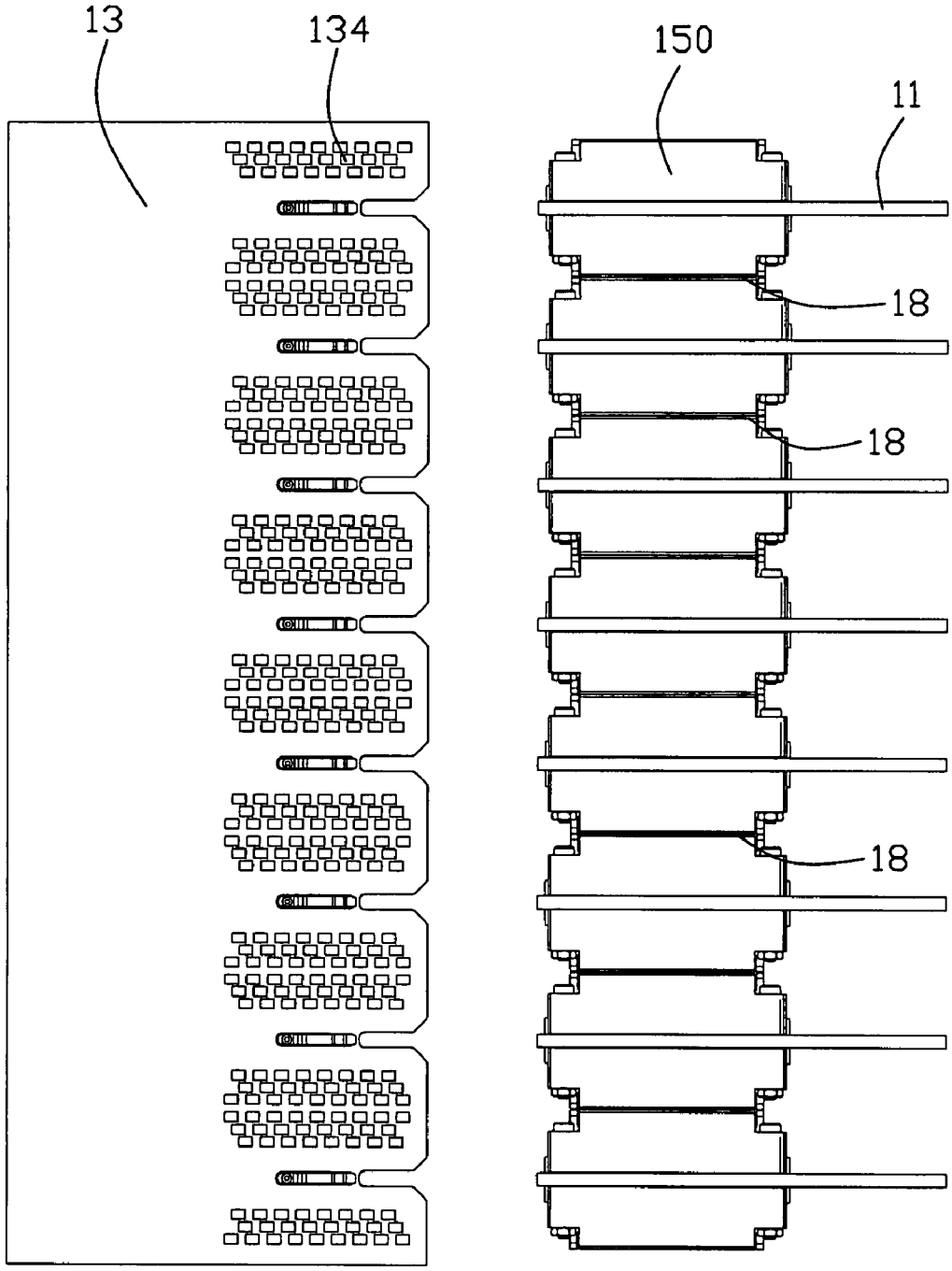
FIG. 5 is a side view of the array of unassembled horizontal boards and vertical boards of FIG. 3.

In this embodiment shown in FIG. 5, the four electrical connectors 15 within each group, in size and in shape, are adapted to aid in mating of actuating member 131 (to be later described) of each vertical board 13 with each group of electrical connectors 15 on the adjacently-stacked horizontal boards 11 whereby vertical gaps 18 of even or uneven distances, along a longitudinal direction, may be controllably formed between the adjacent groups of electrical connectors 15. In other words, the size and shape of the electrical connectors 15, within each group, act as spacer blocks to control location of the multiple boards within the connector housing 100. In this embodiment, the vertical gaps 18, along the longitudinal direction, are of even distances, and the four electrical connectors 15 within each group are the same in size and in shape. It should be noted that the electrical connectors 15 within the respective groups may be of a different shape and/or size, as is determined by the compensation requirement so as to aid in mating of the actuating member of each vertical board 13 with each group of electrical connector 15 on the adjacently-stacked horizontal boards 11. Each electrical connector 15 includes a shell 150 attached thereto. The shell 150 has a generally flat upper surface.

Each vertical board 13 is provided with the actuating members 131 attached thereto for enabling an electrical connection to the electrical connectors 15 on each horizontal board 11. More specifically, when the vertical board 13 with the actuating members 131 thereon is removably inserted into the horizontal board 11 via the group of electrical connectors 15, contact ends of terminals (not shown) included within the electrical connectors 15 are driven by the actuating members 131 to be in direct contact with contact pads 134 of the vertical board 13 and contact pads (not shown) of the horizontal board 11, thereby establishing an electrical interconnection between the horizontal board 11 and the vertical board 13 through the group of electrical connectors 15. As shown in FIG. 7, the actuating member 131 includes a pair of actuator elements 1310 respectively disposed on opposed surfaces of each vertical board 13.

Figure 6:
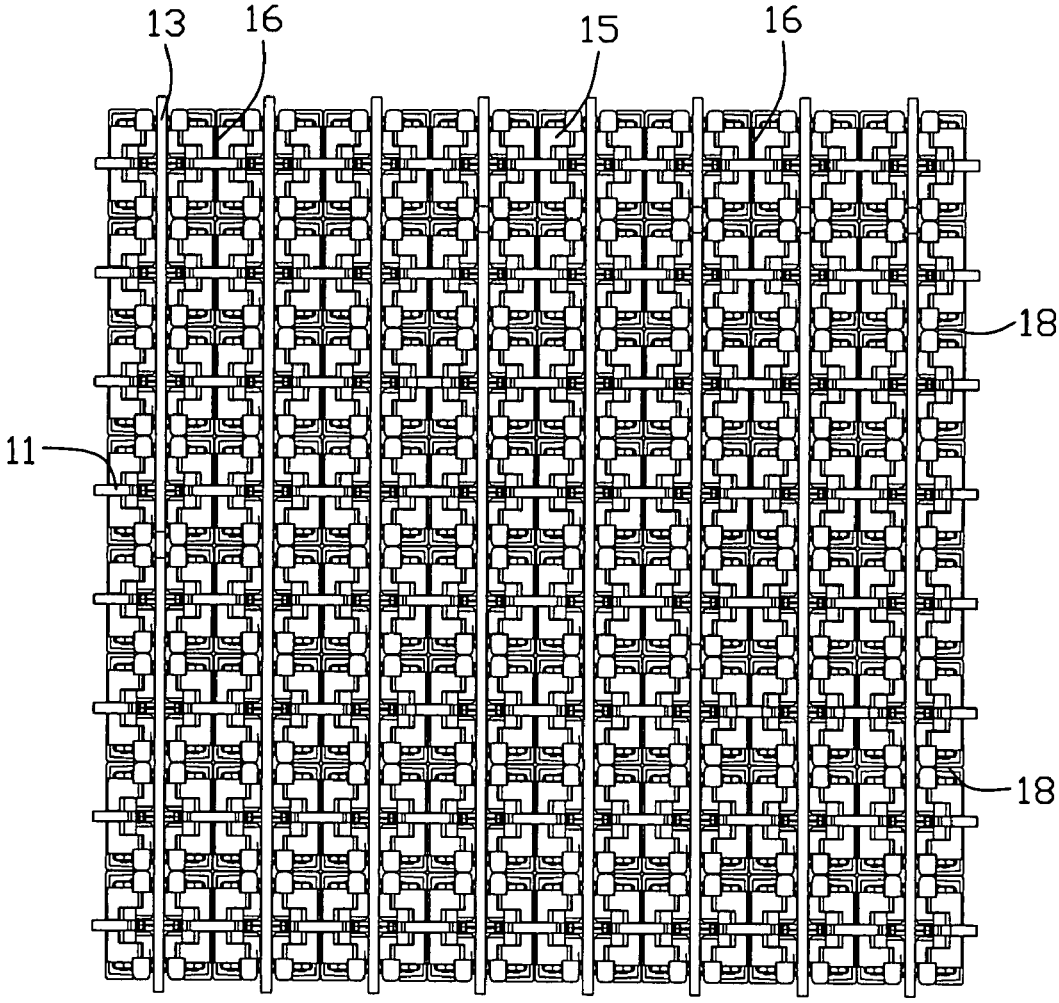
FIG. 6 is a front, assembled view of the array of horizontal boards and vertical boards of FIG. 3.

Referring to FIGS. 1, 3 and 6, in assembly, the horizontal boards 11, are pre-held in position between the side walls 120 of the connector housing 100 by the second holding means 122. In an alternative embodiment, the horizontal boards 11 may be integrally secured on the housing 100 between the opposed side walls 120. The respective groups of electrical connectors 15 are pre-located on the opposed sides of each slot 111 and on the opposite surfaces of each horizontal board 11 such that receiving channels defined by the electrical connectors 15 around the corresponding slots 111 of the adjacently-stacked horizontal boards 11 are adapted for the vertical board 13 to be readily inserted thereinto. The vertical boards 13, in turn, are removably inserted into and further secured onto the horizontal boards 11 by the assist of the guide means 132 between the opposed top wall 110 and bottom wall 130. The guide means 132, after the insertion of the vertical boards 13 into the horizontal boards 11, is also adapted for at least supporting the vertical boards 13 and securely retaining the vertical boards 13 on the housing 100 so as to prevent the vertical boards 13 from being removed due to improper external forces. Thus, this arrangement of the array of horizontal boards 11 and vertical boards 13 with electrical connectors 15 set for an electrical interconnection therebetween and for aiding in mating of each actuating member of the vertical boards with each group of electrical connectors of the horizontal boards will have no mid-plane set between the horizontal boards 11 and the vertical boards 13, which will improve system performance while reducing signal interference and signal attenuation. In the conventional arrangement, the middle portion of the horizontal board along the front edge may be downwardly curved due to gravity thereof so it is desired to have a mid-plane for additional support. In the instant invention, the connectors between the two neighboring horizontal boards may be optionally intimately engaged with each other, so the supporting mid-plane may be omitted. It should be noted that the array of horizontal boards 11 and vertical boards 13 may at least include two horizontal boards 11 and two vertical boards 13.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical interconnection system, comprising:

a plurality of first printed circuit boards adjacently stacked one by one, each said first board including a plurality of slots on a transverse edge thereof, corresponding slots of said adjacently-stacked first boards disposed in an aligned relationship;

a plurality of second printed circuit boards each including a plurality of actuating members disposed along a mating edge thereof, each said second board inserted into said aligned slots of said first boards for intersecting said first boards and forming an arrayed configuration therebetween;

a housing receiving the first boards; and a plurality of groups of electrical connectors, each group including at least two electrical connectors disposed on opposite surfaces of each said first board adjacent the slots, said groups of electrical connectors on every two adjacent first boards cooperating with each other to control a distance between the two adjacent first boards.

2. The electrical interconnection system of claim 1, wherein said at least two electrical connectors within each group, in size and in shape, are adapted to aid in mating of said actuating members of each said second board with said groups of electrical connectors on said adjacently-stacked first boards.

3. The electrical interconnection system of claim 1, wherein four quadrants are defined by each said first board and each said second board, and wherein said group of electrical connectors includes four electrical connectors located at the respective quadrants.

4. The electrical interconnection system of claim 3, wherein said four electrical connectors are the same in size and in shape.

5. The electrical interconnection system of claim 1, wherein said housing includes a first means for securing said first boards on the housing, and a second means for securing said second boards on the housing.

6. The electrical interconnection system of claim 5, wherein said housing includes a top wall, a bottom wall and side walls, said first means are formed on said opposed side walls, and said second means are provided on said opposed top and bottom walls.

7. The electrical interconnection system of claim 6, wherein said second means includes a plurality of parallel channels along an inner surface of said top and bottom walls.

8. The electrical interconnection system of claim 1, wherein each said actuating member includes a pair of actuator elements respectively disposed on opposed surfaces of each said second board.

9. The electrical interconnection system of claim 1, wherein four quadrants are defined by each said first board and each said second board, and wherein said group of electrical connectors includes electrical connectors located at selected quadrants of said first board and said second board.

10. An electrical interconnection system, comprising:

a plurality of first printed circuit boards adjacently stacked one by one, each said first board including a plurality of slots on a transverse edge thereof, corresponding slots of said adjacently-stacked first boards disposed in an aligned relationship;

a plurality of second printed circuit boards each including a plurality of actuating members disposed along a mating edge thereof, each said second board inserted into said aligned slots of said first boards for intersecting said first boards and forming an arrayed configuration therebetween;

a housing receiving the first boards; and a plurality of groups of electrical connectors, each group including electrical connectors disposed on at least one of two opposite surfaces of each said first board adjacent the slots, said groups of electrical connectors on every two adjacent first boards cooperating each other to control a distance between the two adjacent first boards.

11. The electrical interconnection system of claim 10, wherein said electrical connectors within each group, in size and in shape, are adapted to aid in mating of said actuating members of each said second board with said groups of electrical connectors on said adjacently-stacked first boards.

12. An interconnection system comprising:

a plurality of stationary PCBs (printed circuit boards) arranged in a parallel relation with one another;

a plurality of moveable PCBs arranged in a parallel relation with one another while being angled with regard to the stationary PCBs;

a plurality of first slots extending inwardly from a front edge of each of said stationary PCBs in a parallel relation with one another;

a plurality second slots extending inwardly from a front edge of each of moveable PCBs in a parallel relation with one another;

said stationary PCBs and moveable PCBs being intersected with each other via confrontation between the front edges of the stationary PCBs and those of the moveable PCBs and interweaving between the first slots and the second slots so that from a side view said stationary PCBs and said moveable PCBs are arranged in a grid manner defining thereof a plurality of grid units surrounded by the corresponding stationary and moveable PCBs;

four sets of connectors being located at four corner of each of said grid units by which said grid unit is surrounded; wherein the distance between the two neighboring stationary PCBs is determined and controlled by intimate engagement between the two neighboring connectors, in a same grid unit, along a direction perpendicular to said stationary PCBs.

13. The interconnection system as claimed in claim 12, wherein the said sets of connectors in each grid, are respectively secured to the two opposite stationary PCBs surrounding each grid unit.

14. The interconnection system as claimed in claim 12, wherein each of said first slots defines a wider front section and a narrower rear section so as to in said wider front section receive a corresponding actuator which is located on the corresponding moveable PCB.

* * * * *